US007153166B2

(12) United States Patent
Katoh et al.

(10) Patent No.: US 7,153,166 B2
(45) Date of Patent: Dec. 26, 2006

(54) SMALL-SIZE CONNECTOR ENABLING SELECTIVE USE OF DIFFERENT TYPES OF CONNECTION OBJECTS

(75) Inventors: Katsutoshi Katoh, Tokyo (JP); Hiroaki Yasuda, Kanagawa (JP); Mitsuo Tabo, Kanagawa (JP); Nobukazu Kato, Tokyo (JP); Masamichi Sasaki, Tokyo (JP)

(73) Assignees: Lenovo (Singapore) Pte Ltd., Singapore (SG); Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/247,440

(22) Filed: Oct. 11, 2005

(65) Prior Publication Data

US 2006/0084321 A1 Apr. 20, 2006

(30) Foreign Application Priority Data

Oct. 12, 2004 (JP) ..... 2004-297798

(51) Int. Cl.
*H01R 24/00* (2006.01)

(52) U.S. Cl. ..... 439/630; 235/492; 439/945

(58) Field of Classification Search ..... 439/630, 439/945–946, 159, 260, 325, 188; 235/492
See application file for complete search history.

(56) References Cited

U.S. PATENT DOCUMENTS 6,354,881 B1 * 3/2002 Bricaud et al. ..... 439/630
6,641,413 B1 * 11/2003 Kuroda ..... 439/159
6,749,450 B1 * 6/2004 Chen ..... 439/188
6,976,879 B1 * 12/2005 Shishikura et al. ..... 439/630

FOREIGN PATENT DOCUMENTS

JP 2001188883 7/2001

* cited by examiner

*Primary Examiner*—Michael C. Zarroli
(74) *Attorney, Agent, or Firm*—Collard & Roe, P.C.

(57) ABSTRACT

A connector is capable of selectively connecting different types of cards. The connector has a first connector portion having a first contact for connection to a first card, and a second connector portion having a second contact for connection to a second card. The first contact and the first card are connected together in a fitting/removal direction, while, the second contact and the second card are connected together in a direction crossing the fitting/removal direction. When the first contact and the first card are connected together, the second contact is prevented from contacting the first card. When the second contact and the second card are connected together, the first contact is prevented from contacting the second card.

12 Claims, 7 Drawing Sheets

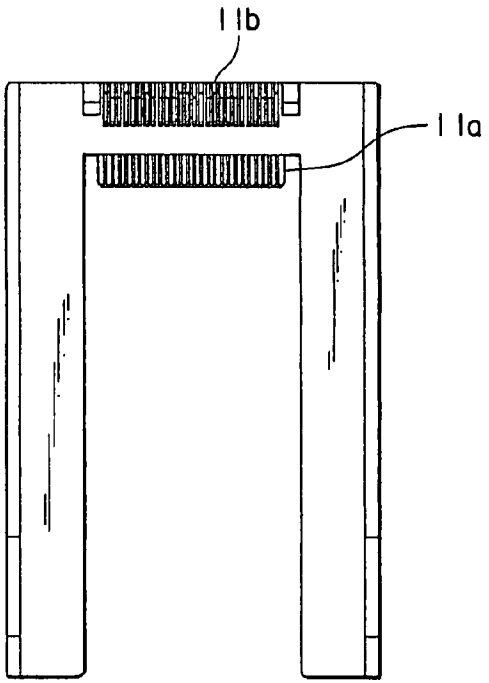
FIG. 4E
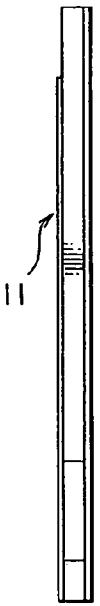
FIG. 4D
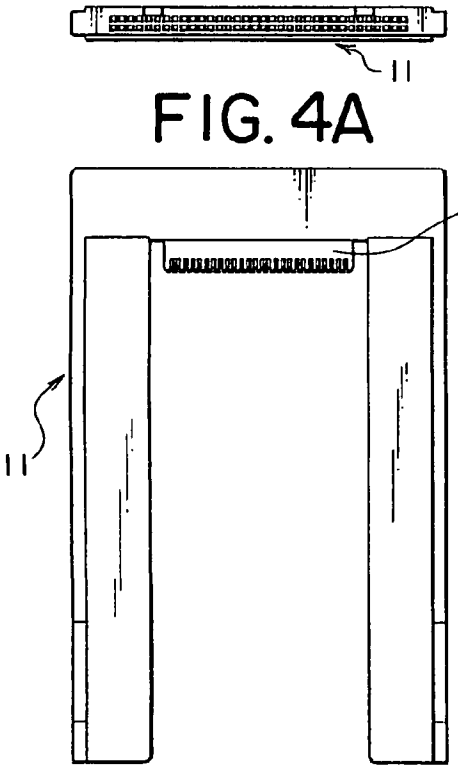
FIG. 4A
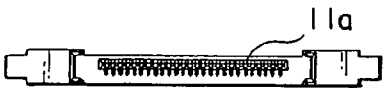
FIG. 4B
FIG. 4C

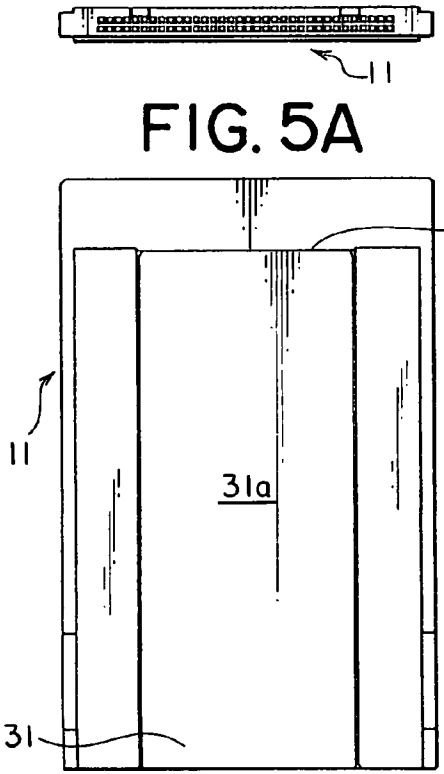
FIG. 5A
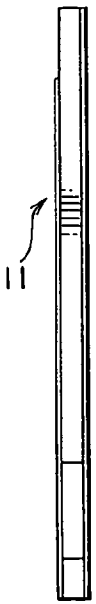
FIG. 5D
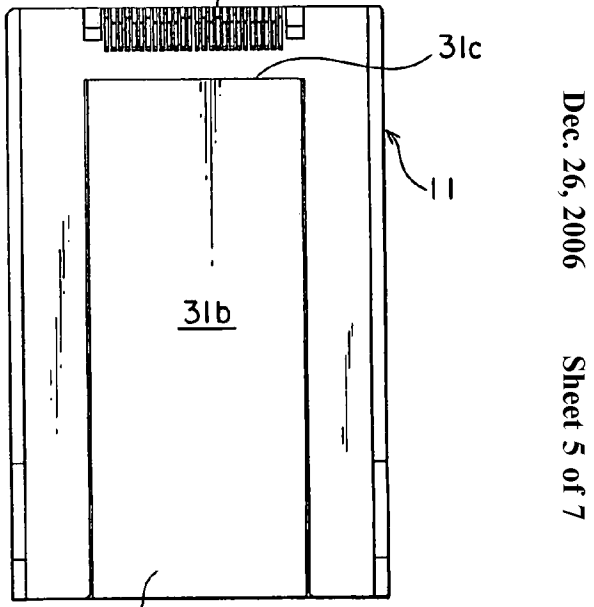
FIG. 5E
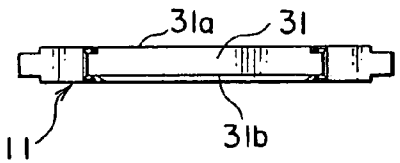
FIG. 5B
FIG. 5C

SMALL-SIZE CONNECTOR ENABLING SELECTIVE USE OF DIFFERENT TYPES OF CONNECTION OBJECTS

This application claims priority to prior Japanese patent application JP 2004-297798, the disclosure of which is incorporated herein by reference.

BACKGROUND OF THE INVENTION

This invention relates to a connector capable of selectively connecting different types of connection objects.

JP-A-2001-188883, for example, discloses a plurality of types of connection adapters each mounted on a device of a personal computer for connecting a connection object such as a memory card. Those connection adapters include the first type connection adapter and the second type connection adapter each having a plurality of slots for selectively mounting therein different types of connection objects. In the first type connection adapter, the plurality of slots extend in parallel while overlapping each other and open to the same plane. In the second type connection adapter, the plurality of slots extend perpendicular to each other and open to the different planes. Each of the first and second type connection adapters enables selective use of the different types of connection objects in the device.

In the first type connection adapter, however, since the plurality of slots extend while overlapping each other, its dimension in a direction of the overlapping, i.e. in a thickness direction, necessarily increases. On the other hand, in the second type connection adapter, since the plurality of slots extend perpendicular to each other, its dimension in a direction perpendicular to a thickness direction necessarily increases. That is, these connection adapters each enable selective use of the different types of connection objects, but increase in size. Therefore, the device requires a large dedicated space for mounting the connection adapter and, further, it is necessary to increase the size of a connector provided in the device for connecting the connection adapter.

SUMMARY OF THE INVENTION

It is therefore an object of this invention to provide a connector that is capable of selectively using different types of connection objects and, further, that can be reduced in size.

Other objects of the present invention will become clear as the description proceeds.

According to an aspect of the present invention, there is provided a connector for connection to a plurality of cards, said connector comprising a first connector portion having first contacts for connection to a first card, and a second connector portion having second contacts for connection to a second card, wherein said first contacts and said first card are connected together in a fitting/removal direction, said second contacts and said second card are connected together in a direction crossing said fitting/removal direction, when said first contacts and said first card are connected together, said second contacts are prevented from contacting said first card, and when said second contacts and said second card are connected together, said first contacts are prevented from contacting said second card.

According to another aspect of the present invention, there is provided a connector for connecting selectively to a first and a second connection object with relative movement in a first direction, the first and the second connection objects being different to each another in a type, the connector comprising a first connector portion having a first contact for coming in contact with the first connection object and a second connector portion placed adjacent to the first connector portion in a second direction perpendicular to the first direction and having a second contact for coming in contact with the second connection object, the second connector portion including an actuator for displacing the first connection object in the second direction in response to the relative movement to a position where the first connection object does not come in contact with the second contact.

BRIEF DESCRIPTION OF THE DRAWINGS

FIG. 4A is a front view of an adapter used for connecting a second card to the connector;

FIG. 4B is a plan view of the adapter;

FIG. 4C is a rear view of the adapter;

FIG. 4D is a side view of the adapter;

FIG. 4E is a bottom view of the adapter;

FIG. 5A is a front view of the state where the second card is loaded in the adapter;

FIG. 5B is a plan view of the same state;

FIG. 5C is a rear view of the same state;

FIG. 5D is a side view of the same state;

FIG. 5E is a bottom view of the same state;

DESCRIPTION OF THE PREFERRED EMBODIMENT

Figure 1A:
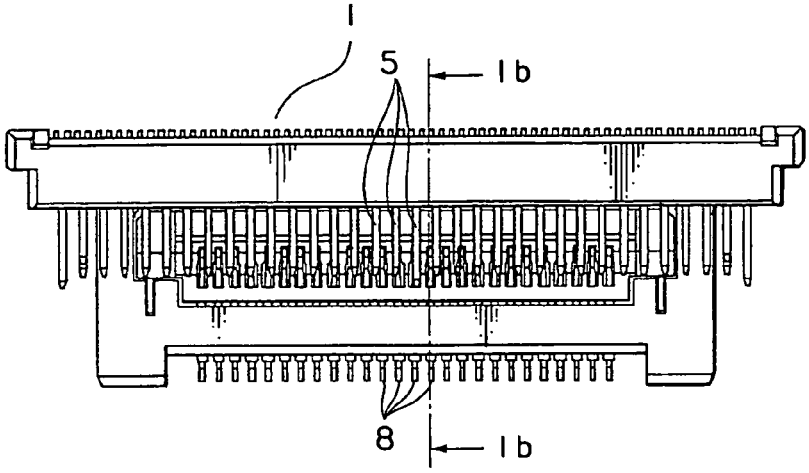
FIG. 1A is a plan view of a connector according to an embodiment of this invention.
Figure 1B:
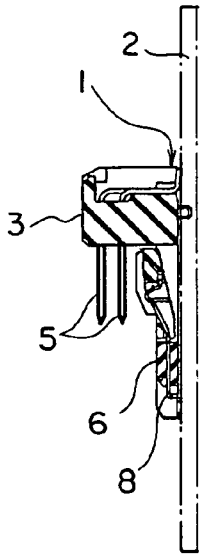
FIG. 1B is a sectional view taken along line Ia—Ia in FIG. 1A.
Figure 1C:
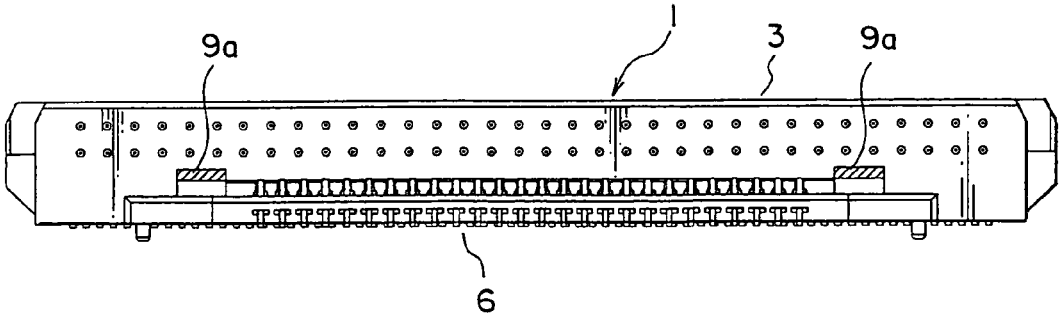
FIG. 1C is an enlarged front view of the connector.

Referring to FIGS. 1A to 1C, 3A, and 3B, description will be made about a connector according to an embodiment of this invention.

The connector 1 is generally mounted on a board 2 and comprises a first connector portion 3 and a second connector portion 6. The first connector portion 3 comprises an insulator 4 and a number of first conductive contacts 5 retained by the insulator 4. The first contacts 5 are each formed in a crank shape and are arranged parallel in two rows. Each first contact 5 has a tip portion extending linearly in a fitting/removal direction with respect to a first card 21. In other words, each first contact 5 has a pin portion extending in a first direction A1.

The second connector portion 6 is disposed on the lower front side of the insulator 4. More particularly, the second connector portion 6 is placed adjacent to the first connector portion 3 in a second direction A2 perpendicular to the first direction A1.

The second connector portion 6 comprises an insulator 7, a number of second conductive contacts 8 retained by the insulator 7, and an actuator 9 fixed to the second contacts 8. Each second contact 8 has an elastically deformable portion 8*a* projecting from the insulator 7 and supporting the actuator 9. The elastically deformable portion 8*a* has elasticity and is provided with a curved projecting portion 8*a*1 at a position facing the first card 21 when connected to the first contacts 5. The actuator 9 is provided with a pair of cam portions 9*a*. The actuator 9 may be provided with a single cam portion 9*a* at the center in its longitudinal direction or with three cam portions 9*a* at the center and both ends in its longitudinal direction. There is no particular limitation to the number of the cam portions 9*a*.

Figure 2:
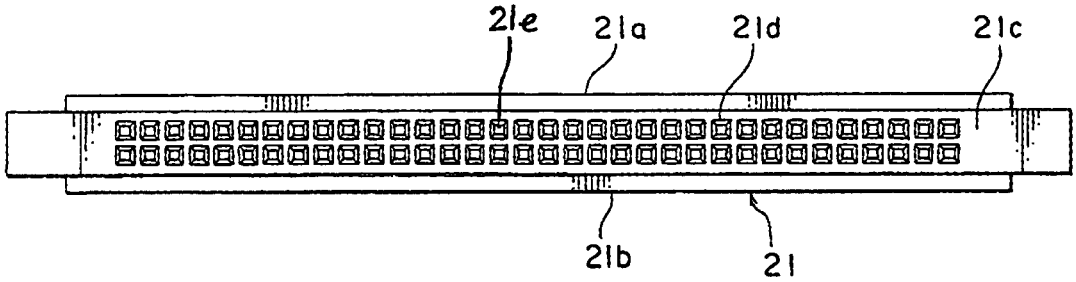
FIG. 2 is a front view of a first card connectable to the connector.
Figure 3A:
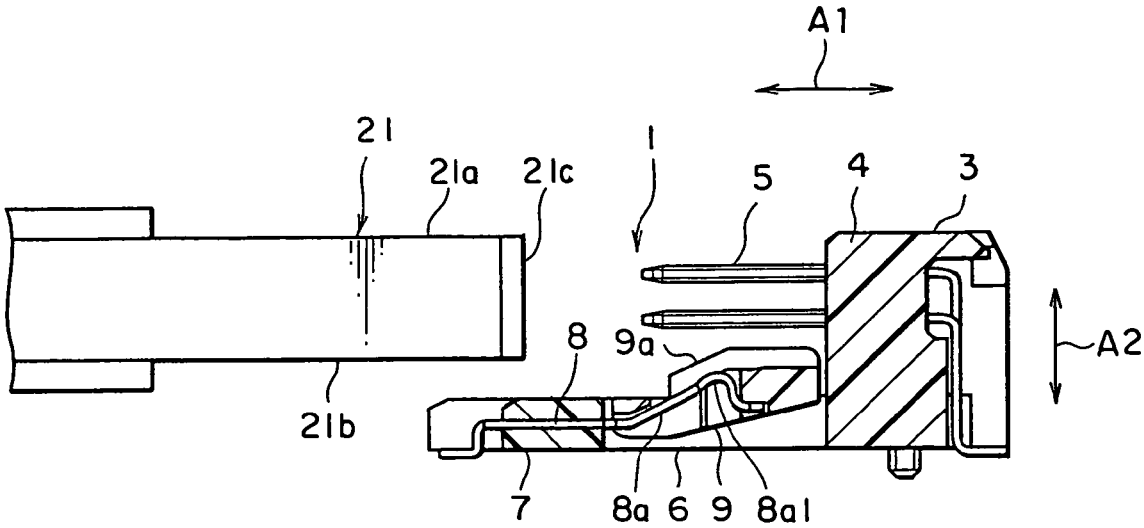
FIGS. 3A and 3B are sectional views, respectively, for explaining the process of connecting the first card to the connector.
Figure 3B:
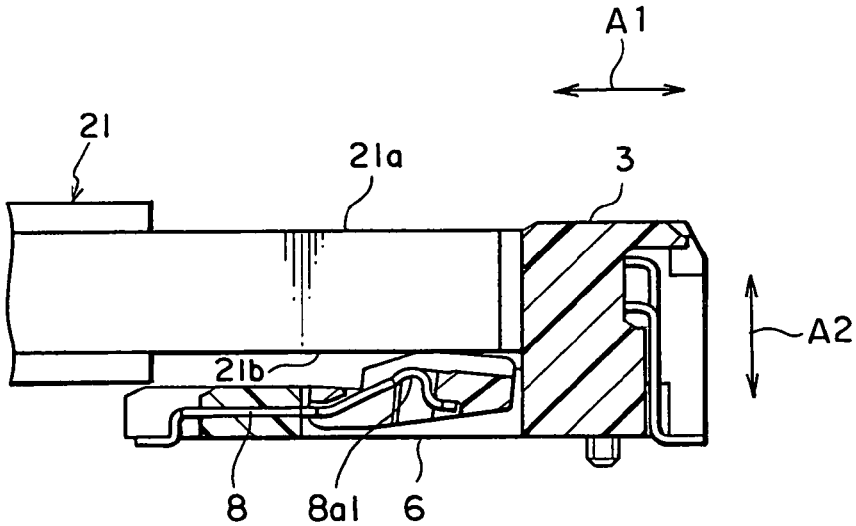

Referring to FIGS. 3A and 3B and also to FIG. 2, description will be made about the first card 21 being a first type connection object and about connection thereof to the connector 1.

The first card 21 is in the form of a substantially flat plate having an upper surface 21*a* and a lower surface 21*b* parallel to each other and has one end surface 21*c* formed with a number of fitting holes 21*d*. Each of the upper and the lower surfaces 21*a* and 21*b* will be referred to as a principal surface. The fitting holes 21*d* are arranged parallel in two rows so as to be in one-to-one correspondence with the first contacts 5. Each fitting hole 21*d* is provided with a contact portion 21*e* for connection to the corresponding first contact 5. The contact portions of the fitting holes 21*d* are not led out either to the upper surface 21*a* or to the lower surface 21*b* of the first card 21.

In order to connect the first card 21 to the connector 1, relative movement is caused therebetween in the first direction A1. More particularly, the first card 21 is moved parallel to the connector 1 from a state before connection shown in FIG. 3A so as to approach the connector 1. During this event, the upper and the lower surfaces 21*a* and 21*b* are kept perpendicular to the second direction A2. Then, the first contacts 5 are inserted into the corresponding fitting holes 21*d* of the first card 21 so as to contact the contact portions, respectively, thereby reaching a connected state shown in FIG. 3B. In this event, since the cam portions 9*a* of the actuator 9 are brought into abutment with the lower surface 21*b* of the first card 21, the curved projecting portions 8*a*1 of the second contacts 8 are prevented from contacting the first card 21.

More particularly, the cam portions 9*a* of the actuator 9 slides on the lower surface 21*b* of the first card 21 in response to the relative movement. In this event, the cam portions 9*a* push upwardly the lower surface 21*b* in the second direction A2. Therefore, the first card 21 is displaced in the second direction A2 to a position where the first card 21 does not come in contact with the first contacts 5.

Figure 6:
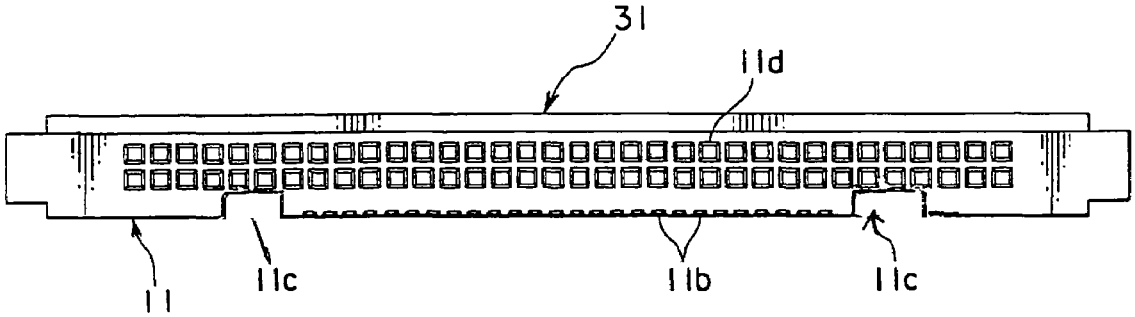
FIG. 6 is an enlarged view of FIG. 5A.

Referring to FIGS. 4A to 4E and 5A to 5E and further to FIG. 6, description will be made about a second card 31 being another type of connection object and about an adapter 11 used for connecting the second card 31 to the connector 1.

The second card 31 is in the form of a substantially flat plate having an upper surface 31*a* and a lower surface 31*b* parallel to each other and has one end surface 31*c* formed with a slot. The slot is provided therein with a number of contact portions (not shown) for connection to the corresponding second contacts 8.

In order to connect the second card 31 to the connector 1, the adapter 11 shown in FIGS. 4A to 4E is used. The adapter 11 is of a generally U-shape in plan view and has a fitting projection 1*a* on the inner side thereof. The adapter 11 is provided with a number of conductive terminals 11*b* each extending from the fitting projection 11*a* to the front end of the adapter 11 at its bottom or principal surface. The terminals 11*b* are arranged at the front end bottom of the adapter 11 so as to be in one-to-one correspondence with the second contacts 8. Further, as clearly shown in FIG. 6, the adapter 11 is formed with a pair of relief portions 11*c* for receiving the cam portions 9*a* of the actuator 9, respectively. Each of the relief portions 11*c* may be a recessed portion recessed from the bottom of the adapter 11 in a thickness direction thereof. There is no particular limitation to the number of the relief portions 11*c*.

The second card 31 is loaded on the inner side of the adapter 11 as shown in FIGS. 5A to 5E. In this event, the fitting projection 1*a* is inserted into the slot of the second card 31. As a result, the terminals 11*b* are brought into contact with the contact portions provided in the slot of the second card 31. In this manner, the adapter 11 and the second card 31 are integrated together as a single card. A combination of the adapter 11 and the second card 31 is referred to as a second type connection object.

Figure 7A:
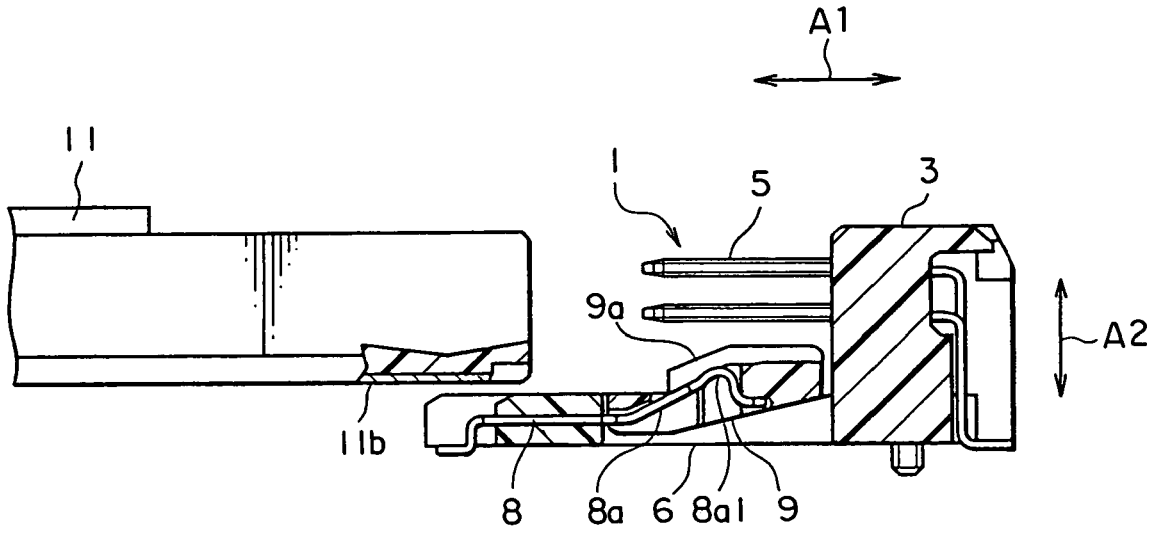
FIGS. 7A and 7B are sectional views, respectively, for explaining the process of connecting the second card to the connector by the use of the adapter.
Figure 7B:
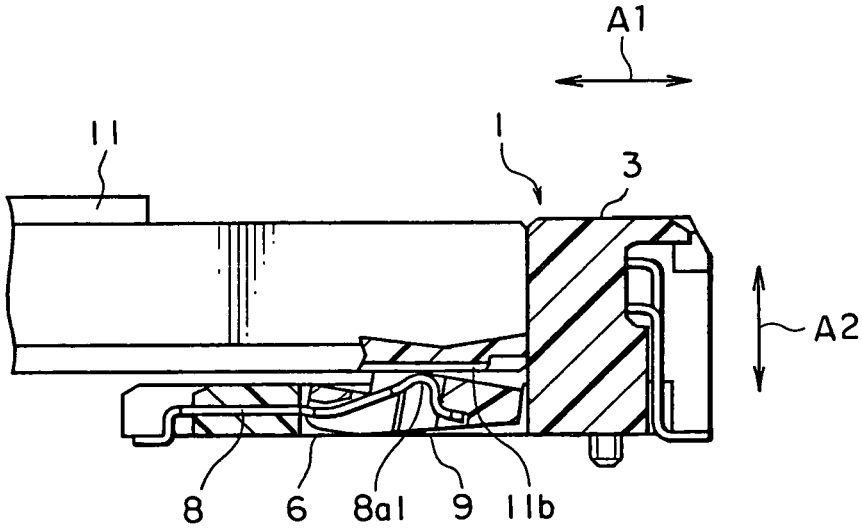

Referring also to FIGS. 7A and 7B, description will be made about connection of the second card 31 to the connector 1.

The adapter 11 loaded with the second card 31 is moved parallel to the connector 1 from a state before connection shown in FIG. 7A so as to approach the connector 1. Then, the terminals 11*b* of the adapter 11 are brought into press contact with the curved projecting portions 8*a*1 of the corresponding second contacts 8 in the second direction A2, thereby reaching a connected state shown in FIG. 7B. As a result, the second contacts 8 are connected to the corresponding contact portions of the second card 31, respectively. In this event, the cam portions 9*a* of the actuator 9 enter the relief portions 11*c* of the adapter 11, respectively, and the first contacts 5 enter concave portions 11*d* of the adapter 11, respectively, so that the connector 1 and the adapter 11 are smoothly fitted together.

The connector 1 can be made in a thin thickness in spite of being capable of selectively connecting the first card 21 and the second card 31 different to each another in the type or a standard.

In the foregoing embodiment, the second card 31 is connected to the adapter 11. However, it is also possible to directly connect the second card 31 to an electronic device without using the adapter 11.

While the present invention has thus far been described in connection with a single embodiment thereof, it will readily be possible for those skilled in the art to put this invention into practice in various other manners. For example, only a single contact may be provided in each of the first and the second connector portions. In this case, the adapter may be designed to have a single relief portion.

What is claimed is:

1. A connector for connection to a plurality of cards to be inserted differently from one another into the connector, said connector comprising a first connector portion having first contacts having a contact portion for connecting to a first card, and a second connector portion having second contacts having a conductivity terminal for connection to a second card, wherein said first contacts and said first card are connected together in a first direction, said second contacts and said second card are connected together in a second direction which is perpendicular to said first direction, when said first contacts and said first card are connected together, said second contacts are prevented from contacting said contact portion, and when said second contacts and said second card are connected together, said first contacts are prevented from contacting said conductive terminal, wherein said second connector portion comprises an actuator and said second contacts are prevented from contacting said contact portion because of abutment of said actuator with said first card, and wherein said second card is loaded in an adapter, said adapter is formed with a relief portion, and, when said second contacts and said second card are connected together, said actuator enters said relief portion so that predetermined connection is carried out.

2. The connector according to claim 1, wherein said actuator comprises a cam portion and said cam portion is brought into abutment with said first card.

3. The connector according to claim 1, wherein said actuator comprises a cam portion and said cam portion enters said relief portion.

4. A connector for connecting selectively to a first and a second connection object with relative movement in a first direction, the first and the second connection objects being different to each another in a type, the connector comprising:

a first connector portion having a first contact for coming in contact with the first connection object; and a second connector portion placed adjacent to the first connector portion in a second direction which is perpendicular to the first direction, said second connector portion having a second contact for coming in contact with the second connection object, the second connector portion including an actuator for positioning the first connection object in response to the relative movement at a position where the first connection object does not come in contact with the second contact.

5. The connector according to claim 4, wherein the first connection object comprises a first card having a principal surface which is perpendicular to the second direction when connected to the connector, the actuator having a cam portion sliding on the principal surface in response to the relative movement with pushing the principal surface in the second direction.

6. The connector according to claim 4, wherein the first contact has a pin portion extending in the first direction.

7. The connector according to claim 6, wherein the first connection object has a fitting hole provided with a contact portion, the first contact being inserted into the fitting hole in accordance with the relative movement to come in contact with the contact portion.

8. The connector according to claim 4, wherein the second connection object has a relief portion facing the actuator in the second direction when the second connection object is connected to the connector, the relief portion making the second connection object be not displaced by the actuator even on the relative movement.

9. The connector according to claim 8, wherein the second connection object comprises a second card and an adapter for holding the second card, the adapter having a terminal to be electrically connected to the second card and coming in contact with the second contact when the second connection object is connected to the connector.

10. The connector according to claim 9, wherein the adapter has a principal surface perpendicular to the second direction when the second connection object is connected to the connector, the terminal being formed on the principal surface of the adapter.

11. The connector according to claim 10, wherein the second contact has elasticity and comes in press contact with the terminal in the second direction when the second connection object is connected to the connector.

12. The connector according to claim 11, wherein the adapter has a concave portion, the first contact having a pin portion extending in the first direction, the first contact being inserted into the concave portion in accordance with the relative movement.

* * * * *